US006837638B1

(12) United States Patent
Noguchi

(10) Patent No.: US 6,837,638 B1
(45) Date of Patent: Jan. 4, 2005

(54) CAPLESS HOLDING DEVICE

(75) Inventor: Yoshio Noguchi, Saitama (JP)

(73) Assignee: Kotobuki & Co., Ltd., Kyoto-fu (JP)

( * ) Notice: Subject to any disclaimer, the term of this patent is extended or adjusted under 35 U.S.C. 154(b) by 0 days.

(21) Appl. No.: 10/828,723

(22) Filed: Apr. 21, 2004

(30) Foreign Application Priority Data

Jun. 3, 2003 (JP) ..... 2003-158352

(51) Int. Cl.[7] ..... B43K 5/16
(52) U.S. Cl. ..... 401/110; 401/99
(58) Field of Search ..... 401/99, 109, 110, 401/111, 112, 116

(56) References Cited

U.S. PATENT DOCUMENTS 1,661,225 A * 3/1928 Kovacs ..... 401/116
2,173,600 A * 9/1939 Thompson ..... 401/78
4,533,272 A * 8/1985 Sakai ..... 401/107
4,844,640 A * 7/1989 Ganz ..... 401/116
5,547,301 A * 8/1996 Kageyama et al. ..... 401/116
5,961,237 A * 10/1999 Kageyama et al. ..... 401/116

FOREIGN PATENT DOCUMENTS

JP 52-49123 9/1993

* cited by examiner

*Primary Examiner*—Gregory L. Huson
*Assistant Examiner*—Huyen Le
(74) *Attorney, Agent, or Firm*—Moser, Patterson & Sheridan, L.L.P.

(57) ABSTRACT

A capless holding device which does not use any removable caps but which can reliably move a medium between a projected position and a housed position is provided. The capless holding device includes a cylinder holding a refill that is movable between a projected position and a housed position. The cylinder includes a tip opening out of which a pen tip of the refill located at the projected position is projected and a housing section that seals the pen tip of the refill located at the housed position. A rotating cylinder is connected to the axial cylinder so as to relatively rotatively movable, an engaging projection integrally provided on the refill, a cam groove formed in the rotating cylinder to guide the engaging projection forward and backward in unison with rotation of the rotating cylinder, and a guide groove formed in the axial cylinder to guide the engaging projection in a rotating direction.

5 Claims, 8 Drawing Sheets

CAPLESS HOLDING DEVICE

CROSS-REFERENCE TO RELATED APPLICATIONS

This application claims benefit of Japanese patent application serial number JP 2003-158352, filed Jun. 3, 2003, which is herein incorporated by reference.

BACKGROUND OF THE INVENTION

1. Field of the Invention

The present invention relates to a capless holding device that does not use a removable cap.

2. Description of the Related Art

As writing implements that do not use a removable cap in order to eliminate the need to remove it and the possibility of losing it, a capless holding device has been known which comprises a cylinder holding a writing member that is movable between a projected position and a housed position, the cylinder comprising a tip opening out of which a tip of the writing member located at the projected position is projected and a housing section that seals the tip of the writing member located at the housed position (refer to, for example, Japanese Patent Laid-Open No. 52-49123).

In the arrangement described in the above-mentioned document, a knock pipe is connected to the cylinder in order to knock the cylinder relative to the writing member. A projecting cam is integrally provided on the writing member. A cam groove is formed in the cylinder. The projecting cam and the cam groove cooperate with each other, and the projecting cam moves along the cam groove to allow the wiring member to move between the projected position and the housed position.

In the conventional capless holding device, the single cam groove guides the forward and backward movement and rotation of the projecting cam. However, it is disadvantageously difficult to reliably move the projecting cam.

The present invention is provided in view of these problems. It is an object of the present invention to provide a capless holding device that can reliably move a medium between a projected position and a housed position.

SUMMARY OF THE INVENTION

To accomplish the above object, a capless holding device according to the present invention comprises a cylinder holding a medium that is movable between a projected position and a housed position, the cylinder comprising a tip opening out of which a tip of the medium located at the projected position is projected and a housing section that seals the tip of the medium located at the housed position. The capless holding device further comprises a rotor rotatively connected to the cylinder, an engaging projection provided on the medium, a cam groove formed on the rotor to guide the engaging projection forward and backward in unison with rotation of the rotor, and a guide groove formed on the cylinder to guide the engaging projection in a rotating direction. The cam groove, the guide groove and the engaging projection cooperate with one another in retracting the medium from the projected position, rotating the medium, and then advancing the medium to the housed position and in retracting the medium from the housed position, rotating the medium, and then advancing the medium to the projected position.

The engaging projection is guided by the cam groove formed on the rotor for guiding the engaging projection forward and backward by rotation of the rotor and the guide groove formed on the cylinder for guiding the engaging projection in the rotating direction. Consequently, the medium can be surely retracted from the projected position, rotated, and then advanced to the housed position. Conversely, the medium can be surely retracted from the housed position, rotated, and then advanced to the projected position.

The cam groove can be V-shaped and comprise a first cam groove and a second cam groove which are inclined in opposite directions relative to an axial direction, the guide groove can be U-shaped and comprises a first guide groove parallel with the axial direction, a second guide groove extending in a circumferential direction, and a third guide groove parallel with the axial direction, and the engaging projection can take the projected position when positioned both in the first cam groove and in the first guide groove and can take the housed position when positioned both in the second cam groove and in the third guide groove.

Using the first cam groove inclined relative to the axial direction, and the first guide groove which is parallel with the axial direction, the engaging projection can be guided forward and backward in the axial direction in unison with the relative rotation between the rotor and the cylinder. Accordingly, the medium can be moved forward or backward to the projected position or from the projected position. Furthermore, the engaging projection can be guided in the circumferential direction through the second guide groove extending in the circumferential direction so that the medium can be rotated. Moreover, using the second cam groove inclined relative to the axial direction, and the second guide groove which is parallel to the axial direction, the engaging projection can be guided forward and backward in the axial direction by the relative rotation between the rotor and the axial cylinder. Accordingly, the medium can be moved forward or backward to the housed position or from the housed position.

A junction between the first guide groove and the second guide groove can cross the first cam groove in front of a top portion of the V-shaped cam groove, and a junction between the third guide groove and the second guide groove can cross the second cam groove in front of the top portion of the V-shaped cam groove. This arrangement can prevent the engaging projection moving in the axial direction along the first guide groove and first cam groove, from reaching the top portion of the V-shaped cam groove and returning in the axial direction along the first guide groove and the second cam groove. Consequently, the engaging projection surely enters the second guide groove before reaching the top portion of the V-shaped cam groove. Similarly, the above arrangement can prevent the engaging projection moving in the axial direction along the third guide groove and second cam groove from reaching the top portion of the V-shaped cam groove and returning in the axial direction along the third guide groove and the first cam groove. Consequently, the engaging projection surely enters the second guide groove before reaching the top portion of the V-shaped cam groove. Thus, the medium can be reliably rotated after retracting in the axial direction.

The second guide groove can have a small first inclined portion and a small second inclined portion both of which are inclined in the axial direction and a transverse guide groove between the first inclined portion and the second inclined portion, and the transverse guide groove can cross the top portion of the V-shaped cam groove. When the engaging projection is guided along the transverse guide groove between the first inclined portion and second inclined portion of the second guide groove, the engaging projection is positioned in the top portion of the V-shaped cam groove. Then, the engaging projection passes through the first or second inclined portion and then moves along the first or second cam groove of the V-shaped cam groove. When passing through the first or second inclined portion, the engaging projection moves from the top portion of the V-shaped cam groove to the next cam groove to which the engaging portion is to move. Thus, the engaging projection can reliably enter the cam groove to which it is to advance and the medium can be reliably advanced after rotating.

The present disclosure relates to subject manner contained in Japanese Patent Application No. 2003-158352, filed on Jun. 3, 2003, which is expressly incorporated herein by reference in its entirety.

DETAILED DESCRIPTION

An embodiment of the present invention will be described with reference to the drawings.

Figure 1:
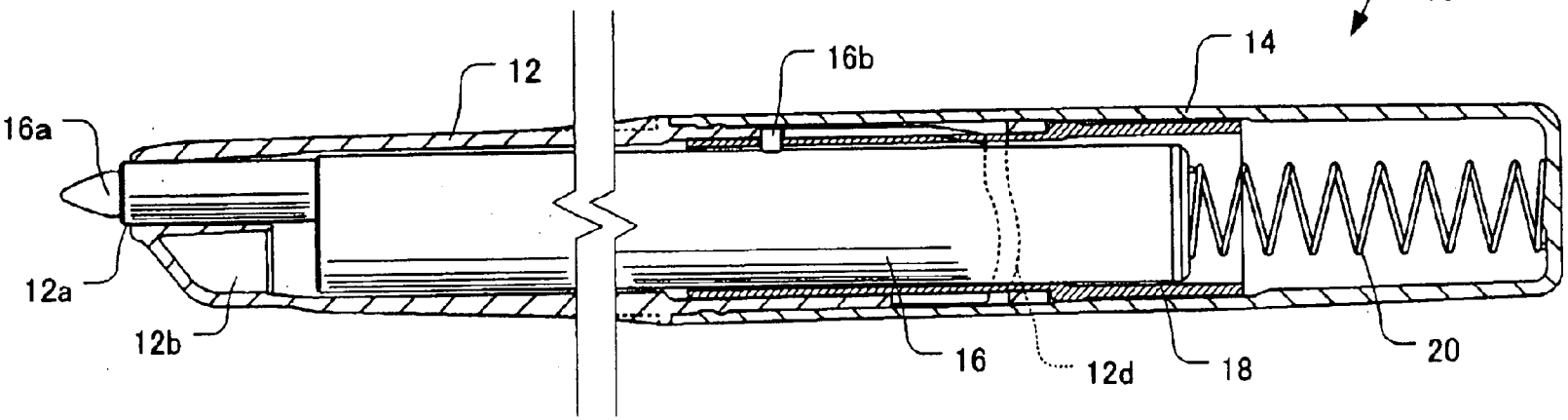
FIG. 1 is a longitudinal sectional view of an entire capless holding device according to the present invention.

FIG. 1 is a longitudinal sectional view of an entire capless holding device according to the present invention. A rear portion of the drawing corresponds to the rotation of its tip portion of the drawing around its axis through 90°.

The capless holding device 10 comprises a cylinder 12 that holds a refill (writing member) 16 as a medium. A tip opening 12*a* is formed in the tip of the cylinder 12 to allow a pen tip 16*a* of the refill 16 to project out of the opening 12*a*. A concave housing section 12*b* is formed inside the tip of the axial cylinder 12 to seal the pen tip 16*a* of the refill 16. The tip opening 12*a* and the housing section 12*b* are each offset from the central axis and separated from each other at a predetermined angle, for example, 180° around the central axis as shown in FIG. 5.

Figures 8A, 8B, 8C:
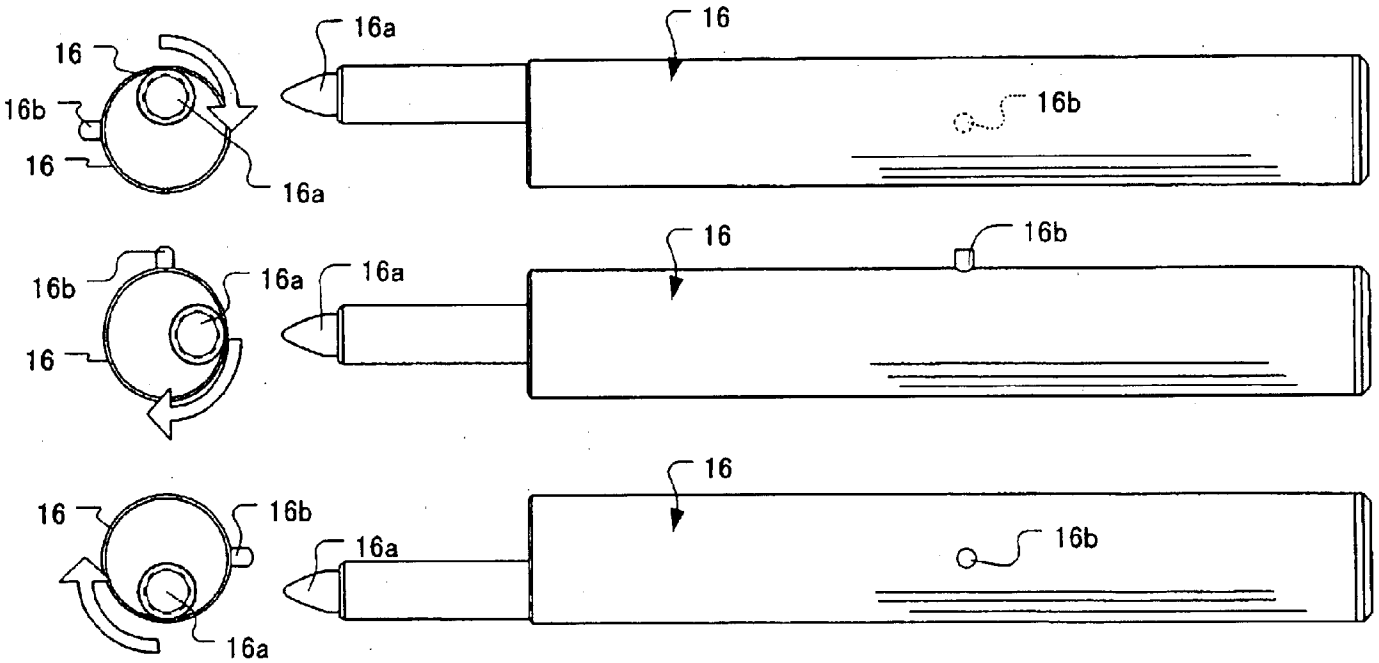
FIG. 8 is a front view and a side view showing that the refill is rotated.

The pen tip 16*a* of the refill 16 is offset from the central axis in association with the positions of the tip opening 12*a* and housing section 12*b* as shown in FIG. 8.

Figure 5B:
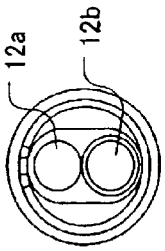
FIG. 5B is a view seen from arrow b in FIG. 5A.
Figure 5A:
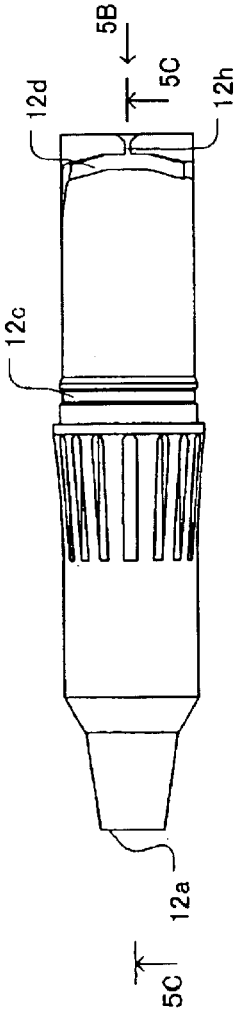
FIG. 5A is a plan view of the axial cylinder.
Figure 5C:
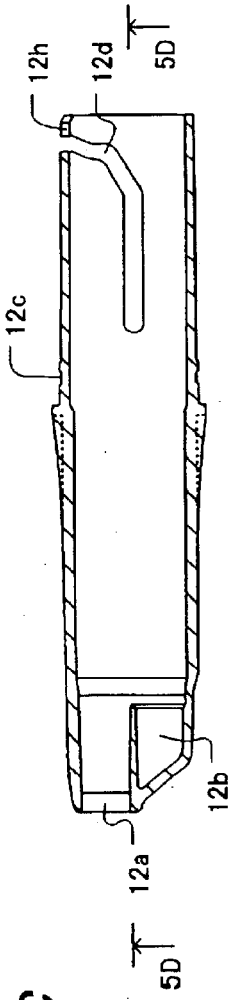
FIG. 5C is a sectional view taken along line c—c in FIG. 5A.
Figure 5D:
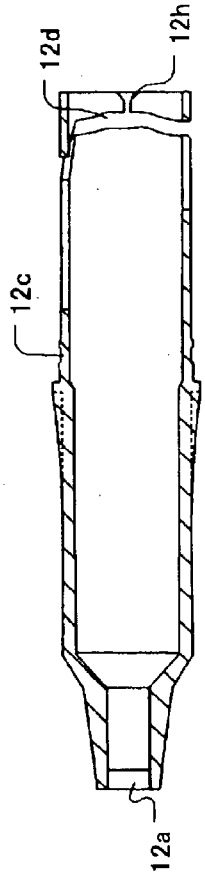
FIG. 5D is a sectional view taken along line d—d in FIG. 5C.
Figure 5E:
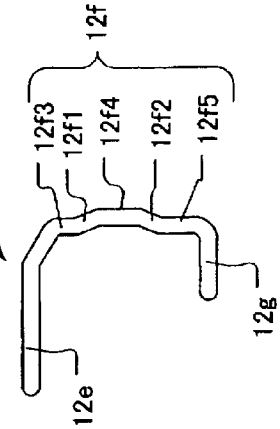
FIG. 5E is a development of the guide groove.
Figure 6A:
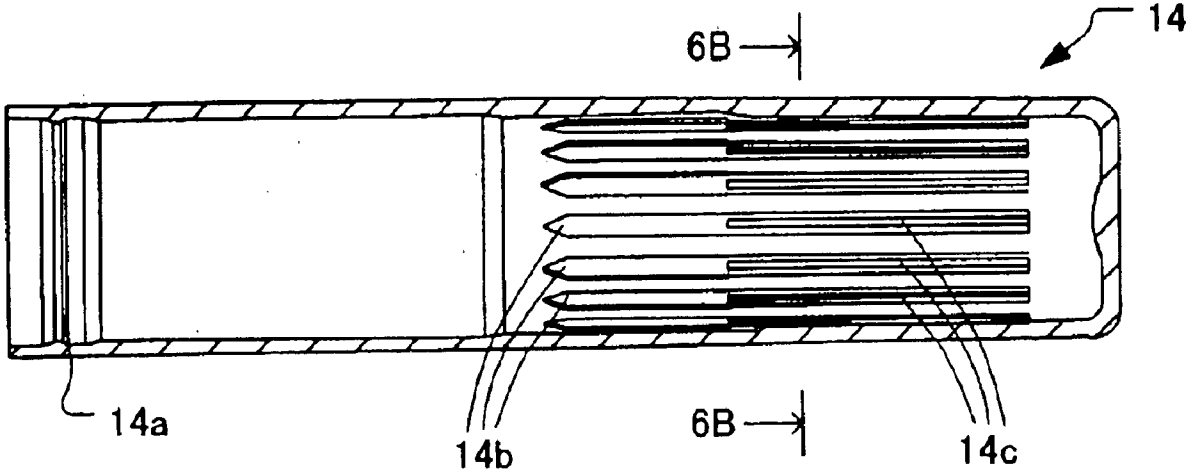
FIG. 6A is a sectional view of a rear cylinder and FIG. 6B is a sectional view taken along line b—b in FIG. 6A.
Figure 6B:
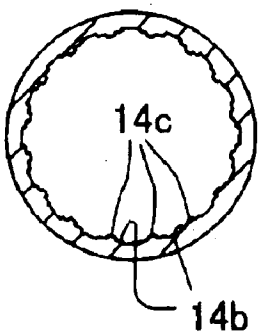
Figure 7A:
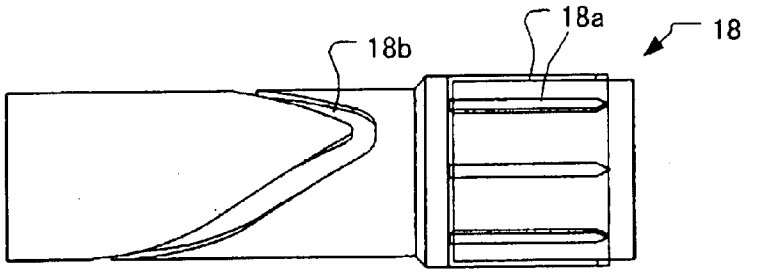
FIG. 7A is a side view of the rotating cylinder.
Figure 7B:
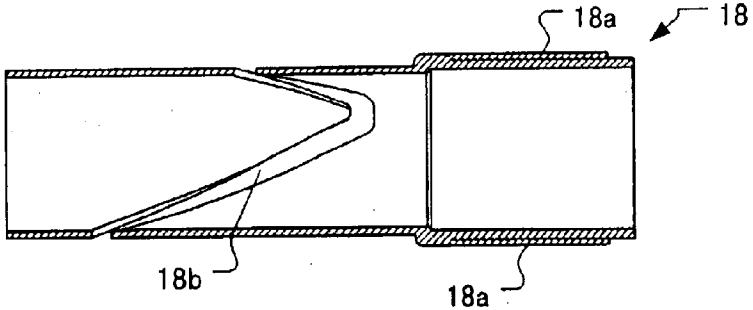
FIG. 7B is a sectional view of the rotating cylinder.

The capless holding device 10 comprises a rear cylinder 14 connected to a rear portion of the cylinder 12 so as to be rotatively movable relative to the cylinder 12 and to be immovable in the axial direction, and a rotating cylinder 18 which rotates integrally with the rear cylinder 14 and which is inserted into the cylinder 12 from its rear portion, the rotating cylinder acting as a rotor. As shown in FIG. 6, annular engaging ribs 14*a* are formed in a front portion of an inner peripheral surface of the rear cylinder 14 so as to engage relatively rotatably with an annular concave portion 12*c* (see FIG. 5) of the cylinder 12. Furthermore, rotation fixing ribs 14*b* are formed in a rear portion of the inner peripheral surface of the rear cylinder 14, and small retreat regulating ribs 14*c* are formed on the respective rotation fixing ribs 14*b*. On the other hand, rotation fixing ribs 18*a* are formed on an outer peripheral surface of the rotating cylinder 18 so as to engage with the rotation fixing ribs 14*b* as shown in FIG. 7. Thus, the rear cylinder 14 and the rotating cylinder 18 can be integrally rotated. The retreat of the rotating cylinder 18 is regulated by the retreat regulating ribs 14*c* of the rear cylinder 14, whereas the advancement of the rotating cylinder 18 is regulated by the cylinder 12. The rotating cylinder 18 is thus arranged so as to be rotatable relative to the cylinder 12 and to be immovable in the axial direction.

A spring 20 is accommodated in the rear cylinder 14 and urges the refill 16 toward the front of the device.

Figure 2:
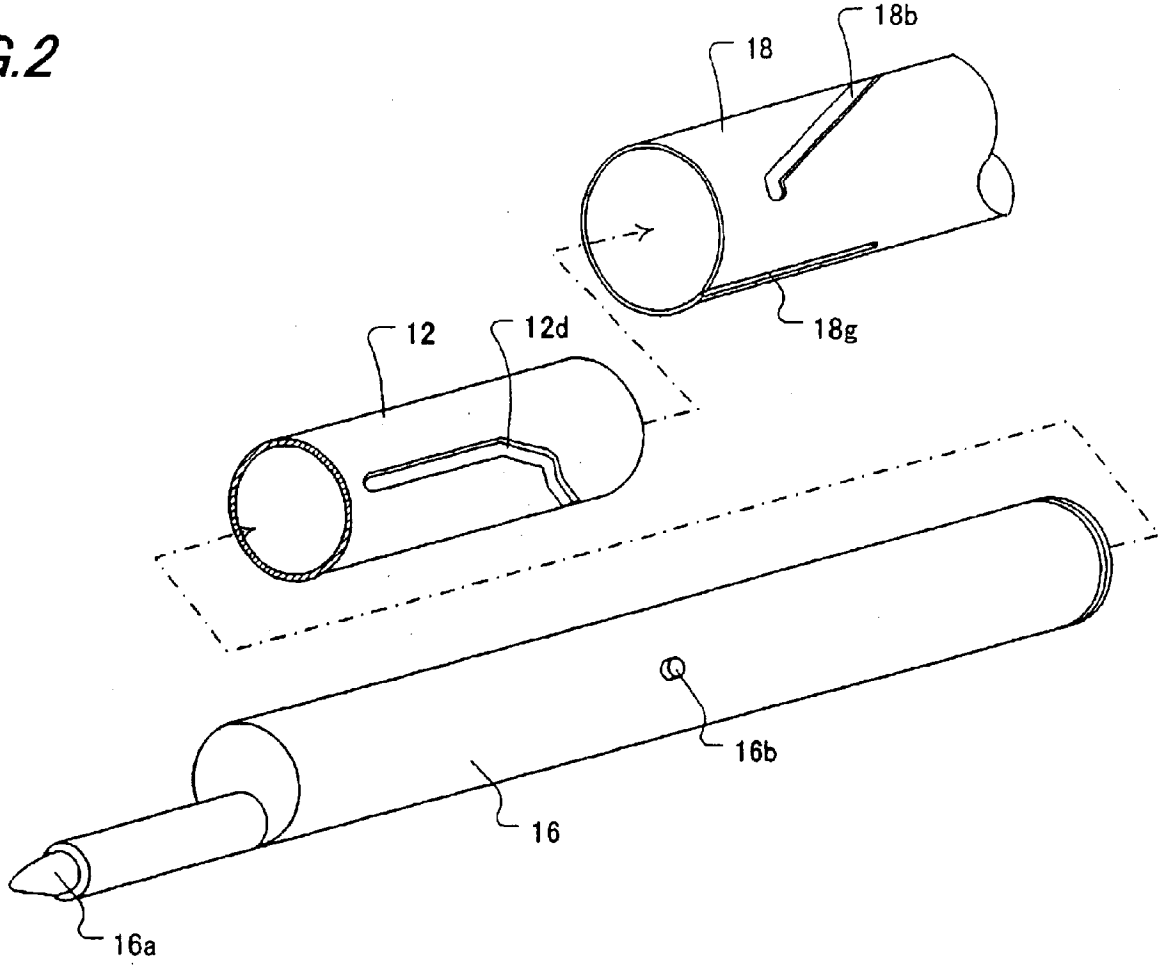
FIG. 2 is an exploded perspective view illustrating an engaging projection of a refill, a guide groove on a cylinder, and a cam groove on a rotating cylinder.

As shown in FIG. 2, an engaging projection 16*b* is formed on an outer circumferential surface of the general part of the refill 16 other than its pen tip 16*a*. A guide groove 12*d* is formed on a peripheral surface of the rear portion of the cylinder 12. A cam groove 18*b* is formed on a peripheral surface of a front portion of the rotating cylinder 18. The engaging projection 16*b* of the refill 16 is slidably fitted in the cam groove 18*b* and the guide groove 12*d*. The engaging projection 16*b*, the cam groove 18*b*, and the guide groove 12*d* cooperate with one another in controlling the movement of the refill 16 between a projected position and a housed position.

Figure 7C:
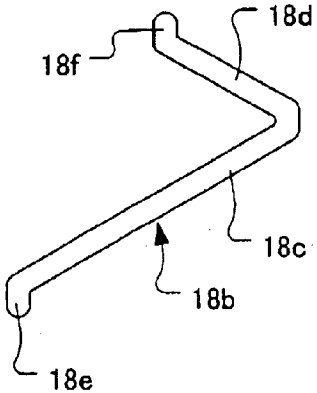
FIG. 7C is a development of the cam groove on the rotating cylinder.

The cam groove 18*b* of the rotating cylinder 18 guides the engaging projection 16*b* mainly forward and backward. As shown in FIG. 7C, the cam groove 18*b* is V-shaped so that the wider part of the letter V corresponds to the front of the device. The cam groove 18*b* is composed of a first cam groove 18*c* which is long and which is inclined relative to the axial direction and a second cam groove 18*d* which is shorter and which is inclined in a direction opposite to that of the first cam groove 18*c* relative to the axial direction. A rear end portion of the first cam groove 18*c* is connected to a rear end portion of the second cam groove 18*d*. Stopper sections 18*e* and 18*f* extending in a circumferential direction are formed at respective distal ends of the first and second cam grooves 18*c* and 18*d*. Furthermore, a slit 18*g* (see FIG. 2) is formed in an area of a peripheral surface of the front portion of the rotating cylinder 18 which area is different from the one where the cam groove 18*b* is formed. The slit 18*g* is used to increase the diameter of the rotating cylinder 18 during an assembly operation when the engaging projection 16*b* is fitted into the cam groove 18*b*.

The guide groove 12*d* of the cylinder 12 guides the engaging projection 16*b* mainly in a rotating direction. As shown in FIG. 5E, the guide groove 12*d* is U-shaped and is composed of a first guide groove 12*e* that is long and parallel with the axial direction, a second guide groove 12*f* that is orthogonal to the axial direction and generally parallel with the circumferential direction, and a third guide groove 12*g* that is short and parallel with the axial direction. The first guide groove 12*e* is slightly inclined in the axial direction in its rear portion. However, a rear end portion of the first guide groove 12*e* and one end portion of the second guide groove 12*f* are connected together. A rear end portion of the third guide groove 12*g* and the other end portion of the second guide groove 12*f* are connected together.

The second guide groove 12*f* further has a small first inclined portion 12*f*1 and a small second inclined portion 12*f*2 both inclined in the axial direction. Furthermore, a transverse guide groove 12*f*3 is formed between an end portion of the first guide groove 12*e* and the first inclined portion 12*f*1. A transverse guide groove 12*f*4 is formed between the first inclined portion 12*f*1 and the second inclined portion 12*f*2. A transverse guide groove 12*f*5 is formed between the second inclined portion 12*f*2 and the third guide groove 12*g*.

An insertion port 12*h* is further formed in the peripheral surface of the rear portion of the cylinder 12 so as to connect a rear end of the cylinder 12 to the second guide groove 12*f*. The insertion port 12*h* is used to fit the engaging projection 16*b* into the guide groove 12*d* during assembly.

Figures 3A, 3B, 3C:
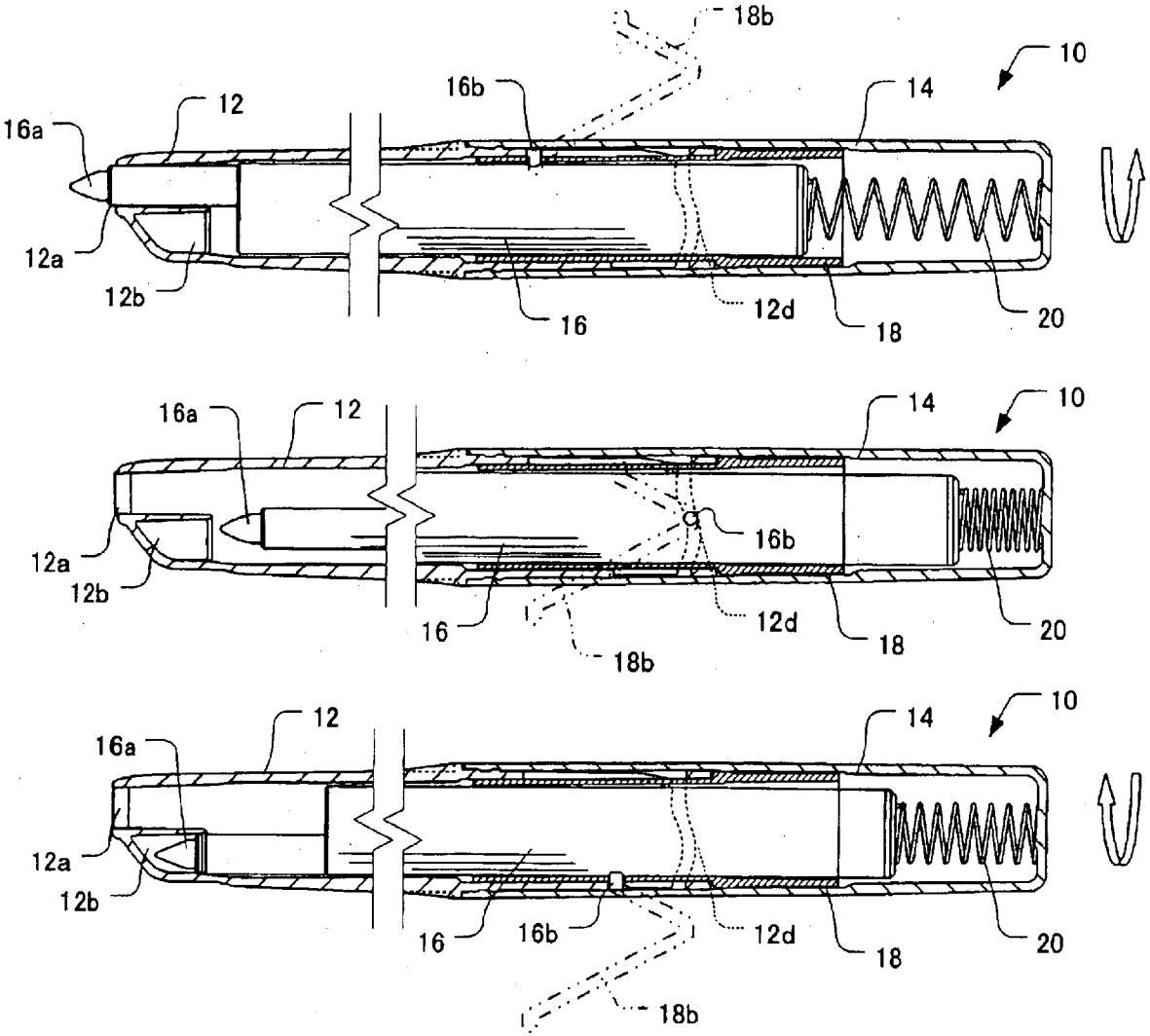
FIG. 3 is a sectional view illustrating operations of the engaging projection of the refill, the guide groove on the axial cylinder, and the cam groove on the rotating cylinder.
Figure 4:
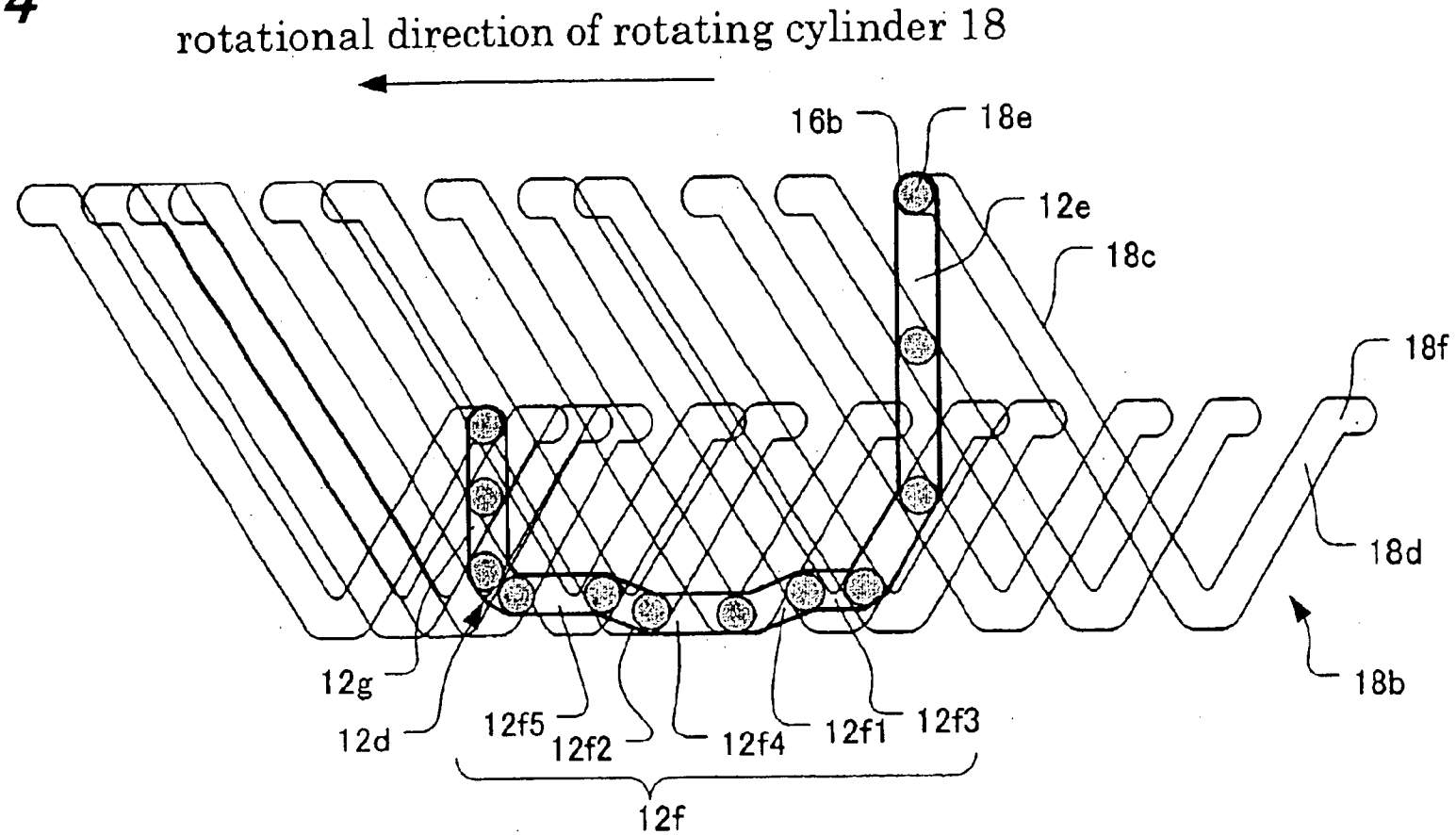
FIG. 4 is a development illustrating operations of the engaging projection of the refill, the guide groove on the axial cylinder, and the cam groove on the rotating cylinder.

With reference to FIGS. 3 and 4, description will be given of operations of the capless holding device 10 configured as described above. First, when the refill 16 is at the projected position, the engaging projection 16*b* is positioned in a stopper section 18*e* located at a distal end portion of the first cam groove 18*c* of the cam groove 18*b*, and in a distal end portion of the first guide groove 12*e* of the guide groove 12*d*. In other words, the rotating cylinder 18 and the cylinder 12 establishes the positional relationship in which the stopper section 18*e* located at the distal end of the first cam groove 18*c* in the rotating cylinder 18 coincides with the distal end portion of the first guide groove 12*e* in the cylinder 12. Then, when the pin tip 16*a* is pressed against a surface of a sheet or the like for writing, pressure is exerted on the pen tip 16*a*. However, the engaging projection 16*b* is prevented from backward movement by the stopper section 118*e*. This allows the pen tip 16*a* to be used.

Then, to finish the use of the refill 16 and house the pen tip 16*a*, the rear cylinder 14 is rotated in a predetermined direction relative to the cylinder 12. The rotating cylinder 18 rotates relative to the cylinder 12 in unison with rotation of the rear cylinder 14. The engaging projection 16*b* is positioned in the first guide groove 12*e*. The first guide groove 12*e* hinders the engaging projection 16*b* from rotating with the rotating cylinder 18. Thus, the engaging projection 16*b* moves out of the stopper section 18*e* and then retracts in the axial direction along the first cam groove 18*c* and the first guide groove 12*e*. Consequently, the refill 16 retracts linearly in the axial direction relative to the cylinder 12.

The engaging projection 16*b* retracts through the first cam groove 18*c* and the first guide groove 12*e*. Then, before reaching a top portion of the V shape of the cam groove 18*b*, the engaging projection 16*b* moves to the transverse guide groove 12*f*3 of the second guide groove 12*f*. The engaging portion 16*b* is then guided in the circumferential direction, that is, in the rotating direction by the transverse guide groove 12*f*3. At this time, it is important that the rear end portion (proximal end portion) of the first cam groove 18*c* does not coincide with the rear end portion (proximal end portion) of the first guide groove 12*e*. This means that the top portion of the V shape of the cam groove 18*b* does not coincide with the junction between the first guide groove 12*e* and the second guide groove 12*f*. If they coincided with each other, the engaging projection 16*b* having reached the rear end portion of the first cam groove 18*c* would not move to the second guide groove 12*f* but advance linearly again along the second cam groove 18*d* and the first guide groove 12*e*. Accordingly, to ensure that the engaging projection 16*b* moves from the first guide groove 12*e* to the second guide groove 12*f*, the junction between the first guide groove 12*e* and the second guide groove 12*f* crosses the first cam groove 18*c* in front of the rear end portion (proximal end portion) of the first cam groove 18*c*, that is, in front of the top portion of the V shape of the cam groove 18*b*.

Thus, the engaging projection 16*b* moves to the transverse guide groove 12*f*3 of the second guide groove 12*f*, which is generally parallel with the circumferential direction. At this time, the engaging projection 16*b* is guided in the circumferential direction, that is, in the rotating direction by the second guide groove 12*f*. The engaging projection 16*b* is thus rotated around the axis relative to the cylinder 12. The engaging projection 16*b* passes through the first inclined portion 12*f*1 of the second guide groove 12*f* and then through the transverse guide groove 12*f*4. While moving through the transverse guide groove 12*f*4, the engaging projection 16*b* is located in substantially the top portion of the V shape of the cam groove 18*b*. That is, in this positional relationship, the transverse guide groove 12*f*4 can cross the top portion of the V shape of the cam groove 18*b*. Then, upon reaching the second inclined portion 12*f*2, the engaging projection 16*b* moves into a side of the second cam groove 18*d* in substantially the top portion of the V shape of the cam groove 18*b*. Importantly, the second inclined portion 12*f*2 allows the engaging projection 16*b*, which is in the top portion of the V shape of the second cam groove 18*b*, to move from a rear end portion of the first cam groove 18*c* and to abut against a wall surface of the rear end portion of the second cam groove 18*d* so that the switching is carried out. If the second inclined portion 12*f*2 were not provided and the second guide groove 12*f* were connected directly to the third guide groove 12*g*, the engaging projection 16*b* would attempt to move to the first cam groove 18*c* to cause meshing, resulting in malfunctioning.

The engaging projection 16*b* thus shifted to the second cam groove 18*d* is guided in the circumferential direction, that is, in the rotating direction by the transverse guide groove 12*f*5. The engaging projection 16*b* then reaches the third guide groove 12*g*. Thus, the engaging projection 16*b*, that is, the refill 16 cannot rotate relative to the cylinder 12 but advances along the third guide groove 12*g* and the second cam groove 18*d*. That is, the refill 16 advances linearly in the axial direction relative to the cylinder 12. The refill 16 finally moves to the stopper groove 18*f*, located at the distal end portion of the second cam groove 18*d*. This movement places the pen tip 16*a* of the refill 16 in the housing section 12*b* of the cylinder 12. The pen tip 16*a* is then sealed by the housing section 12*b*, and the refill 16 is placed in the housed position.

While the refill 16 is in the housed position, the pen tip 16*a* is urged by the spring 20 so as to be housed in the housing section 12*b*. Accordingly, the stopper groove 18*f* may be omitted.

In order to move the refill 16 from the housed position to the projected position, the rear cylinder 14 is rotated in the direction opposite to the one described above. It will be obvious that in this case, the operations of the transverse guides 12*f*5 and 12*f*3 are reversed, and the operations of the first and second inclined portions 12*f*1 and 12*f*2 are reversed. Accordingly, the junction between the second guide groove 12*f* and the third guide groove 12*g* crosses the second cam groove 18*d* in front of the rear end portion (proximal end portion) of the second cam groove 18*d*, that is, in front of the top portion of the V shape of the cam groove 18*b*.

As described above, the refill 16 can be reliably moved between the projected position and the housed position using the engaging projection 16*b* of the refill 16, the guide groove 12*d* in the cylinder 12, and the cam groove 18*b* in the rotating cylinder 18.

In this embodiment, the rear cylinder 14 is provided, which rotates integrally with the rotating cylinder 18 to rotate it. However, the rear cylinder 14 may be omitted and the rotating cylinder 18 may be directly rotated.

Alternatively, it is possible to provide an operation member connected to the rear cylinder 14 via a rotating cam mechanism or the like so that the rear cylinder 14 is rotated by knocking the operation member relative to the cylinder. With this arrangement, each knocking operation switches the rotating direction of the rear cylinder 14.

Alternatively, in this embodiment, an integrally constructed part, for example, the cylinder, rotating cylinder, or refill may of course be composed of a plurality of connected parts. For example, a medium as a refill may of course be composed of a plurality of parts including one having a tip and one having an engaging projection.

Moreover, in this embodiment, capless writing implements have been explained as an example of a capless holding device. However, the present invention is applicable not only to such stationary but also to capless cosmetics. The medium may include not only a refill holding ink but also a solid paste, a lipstick, an eye pencil, an eyeliner, and an eyebrow pencil.

As described above, according to the present invention, the engaging projection is guided by the cam groove formed in the rotor to guide the engaging projection forward and backward in unison with the rotation of the rotor and by the guide groove formed in the axial cylinder to guide the engaging projection in the rotating direction. Consequently, the medium can be surely retracted from the projected position, rotated, and then advanced to the housed position. Conversely, the medium can be surely retracted from the housed position, rotated, and then advanced to the projected position.

While the principles of the invention have been described above in connection with specific embodiments, and particular modifications thereof, it is to be clearly understood that this description is made only by way of example and not as a limitation on the scope of invention.

What is claimed is:

1. A capless holding device comprising a cylinder for holding a medium that is movable between a projected position and a housed position, the cylinder comprising a tip opening out of which a tip of the medium located at the projected position to be projected and a housing section for sealing the tip of the medium located at the housed position, the capless holding device comprising:

a rotor connected to the cylinder so as to relatively rotatively movable;

an engaging projection provided on the medium; and, a cam groove formed on the rotor to guide the engaging projection forward and backward in unison with rotation of the rotor, wherein a guide groove is formed on the cylinder to guide the engaging projection in a rotating direction, and the cam groove, the guide groove and the engaging projection cooperate with one another in retracting the medium from the projected position, rotating the medium, and then advancing the medium to the housed position and in retracting the medium from the housed position, rotating the medium, and then advancing the medium to the projected position.

2. The capless holding device according to claim 1, wherein said cam groove is V-shaped and comprises a first cam groove and a second cam groove which are inclined in opposite directions relative to an axial direction, said guide groove is U-shaped and comprises a first guide groove substantially parallel with the axial direction, a second guide groove substantially extending in a circumferential direction, and a third guide groove substantially parallel with the axial direction, and the engaging projection can take the projected position when positioned in the first cam groove and in the first guide groove and can take the housed position when positioned in the second cam groove and in the third guide groove.

3. The capless holding device according to claim 2, wherein a junction between said first guide groove and said second guide groove crosses said first cam groove in front of a top portion of the V-shaped cam groove, and a junction between said third guide groove and said second guide groove crosses said second cam groove in front of the top portion of the V-shaped cam groove.

4. The capless holding device according to claim 3, wherein said second guide groove has a small first inclined portion and a small second inclined portion both of which are inclined in the axial direction and a transverse guide groove between the first inclined portion and the second inclined portion, and the transverse guide groove can cross the top portion of the V-shaped cam groove.

5. The capless holding device according to claim 2, wherein said second guide groove has a small first inclined portion and a small second inclined portion both of which are inclined in the axial direction and a transverse guide groove between the first inclined portion and the second inclined portion, and the transverse guide groove can cross the top portion of the V-shaped cam groove.

* * * * *